United States Patent [19]

Blom et al.

[11] 4,013,244

[45] Mar. 22, 1977

[54] DEVICE FOR CONTROLLING THE POWER OF AN OPTICAL GUIDANCE BEAM

[75] Inventors: Rolf Helge Blom; Sten Harald Ragnar Forshufvud; Lars-Erik Skagerlund, all of Karlskoga, Sweden

[73] Assignee: AB Bofors, Bofors, Sweden

[22] Filed: Aug. 28, 1975

[21] Appl. No.: 608,819

[30] Foreign Application Priority Data

Aug. 28, 1974 Sweden ..... 7410865

[52] U.S. Cl. ..... 244/3.13; 244/3.16

[51] Int. Cl.[2] ..... F42B 15/02; F41G 9/00; F41G 15/10

[58] Field of Search ..... 244/3.13, 3.16; 356/4

[56] References Cited

UNITED STATES PATENTS

| | | | |
|---|---|---|---|
| 3,815,994 | 6/1974 | Peckham | 356/4 |
| 3,898,007 | 8/1975 | Wiklund | 356/4 |

*Primary Examiner*—Samuel W. Engle
*Assistant Examiner*—Thomas H. Webb
*Attorney, Agent, or Firm*—Pollack, Vande Sande & Priddy

[57] ABSTRACT

Apparatus for controlling the output power of a laser diode the beam of which is directed in a selected direction toward a target so as to enable a missile or the like to be directed along the beam toward the target. The apparatus includes a circuit which supplies a variable amount of power to the diode, and a circuit which is responsive to the radiation emitted by the diode, and the latter circuit generates a signal which is proportional to the magnitude of the emitted radiation. A control circuit is provided which is initiated into operation at the time of firing of the missile and generates a signal which represents the desired increase in magnitude of the radiation emitted by the diode during the time of travel of the missile toward the target. A further signal compares the signal which is proportional to the desired magnitude of the radiation with the signal which is proportional to the magnitude of the radiation emitted by the diode, and the difference between these signals is then used to control the amount of power supplied to the diode.

3 Claims, 3 Drawing Figures

DEVICE FOR CONTROLLING THE POWER OF AN OPTICAL GUIDANCE BEAM

The present invention relates to a device for controlling the power of one or several optical beams, which originate in a light-emitting device, and are symmetrically located in relation to the direction in which the light-emitting device is aimed.

A device of the above-mentioned kind is intended for systems for optical guidance beam control of a missile or the like in which, by means of a light-emitting device mounted at or in the vicinity of the launching position for the missile, a narrow optical beam is transmitted which is aimed substantially along the line of sight from the light-emitting device to the target towards which the missile is to be guided. The missile is provided with a radiation detector which is influenced by the beam transmitted, and generates a corresponding electric signal from which the position of the missile in relation to the line of sight in the sweep direction of the beam can be derived, this information then being utilized in the guidance system of the missile for guiding the missile to follow the line of sight to the target.

The power that the transmitter needs to transmit is determined, into alia, by damping in the rocket smoke and the atmosphere, and by the square law dependence of irradiance on distance. If, however, the power is kept constant during the entire firing process, problems will arise in the beginning of the missile's flight due to the limited dynamics in the amplifier of the receiver. (By "dynamics" is then being meant the relation between the largest signal that can be amplified linearly and the smallest signal that gives an acceptable signal-to-noise ratio). The irradiance at a short distance from the transmitter is very great, and the radiation is dispersed in the rocket smoke, so that the signal reaches the receiver in a disadvantageous manner.

The purpose of the present invention is therefore to create an improved device for determining the deviation particularly of a moving object from a reference line extending from a reference point at a distance from the object, particularly for optical guidance beam control of a missile, with which device the above-mentioned problems are satisfactorily solved.

In the following, the invention will be described with reference to the accompanying drawings, which show an advantageous embodiment of the invention.

Figure 1:
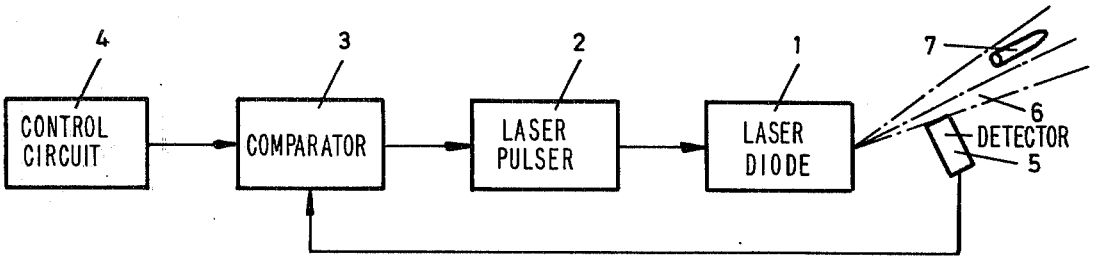
FIG. 1 is a block diagram illustrating the basic arrangement for controlling the power of a guidance beam for control of a missile.

FIG. 1 shows the general design of a system for controlling the output power of a laser diode 1. The output of the laser diode is dependent on the pulse energy from the pulser 2, and increases rapidly with the pulse energy supplied until the power reaches a certain saturation value, after which a further increase of the pulse energy only gives an insignificant increase of the output. In order to be able to vary the output of the laser diode, the pulse energy fed is controlled with the aid of a comparator 3, which compares a target value indicated by the control circuit 4 with a signal emitted from the detector 5. The detector can consist of, for example, photo detector which picks up part of the radiation emitted from the laser and in dependence on this radiation, emits a signal to the comparator. The comparator 3 generates an output signal which is dependent on the difference between the signal emitted from the detector and the signal emitted from the control circuit 4, which output signal is fed to the pulser 2. The radiation from the laser diode is transmitted in the form of a narrow beam 6. The missile 7 is provided with a radiation detector, which is influenced by the beam transmitted and generates a corresponding electric signal from which the position of the missile in the guidance corridor can be derived, this information then being utilized in the guidance system of the missile for guiding the missile to follow the line of sight to the target.

The laser diode and its control devices can be made in a way which is known in itself, and which will therefore not be described in detail.

Figure 2:
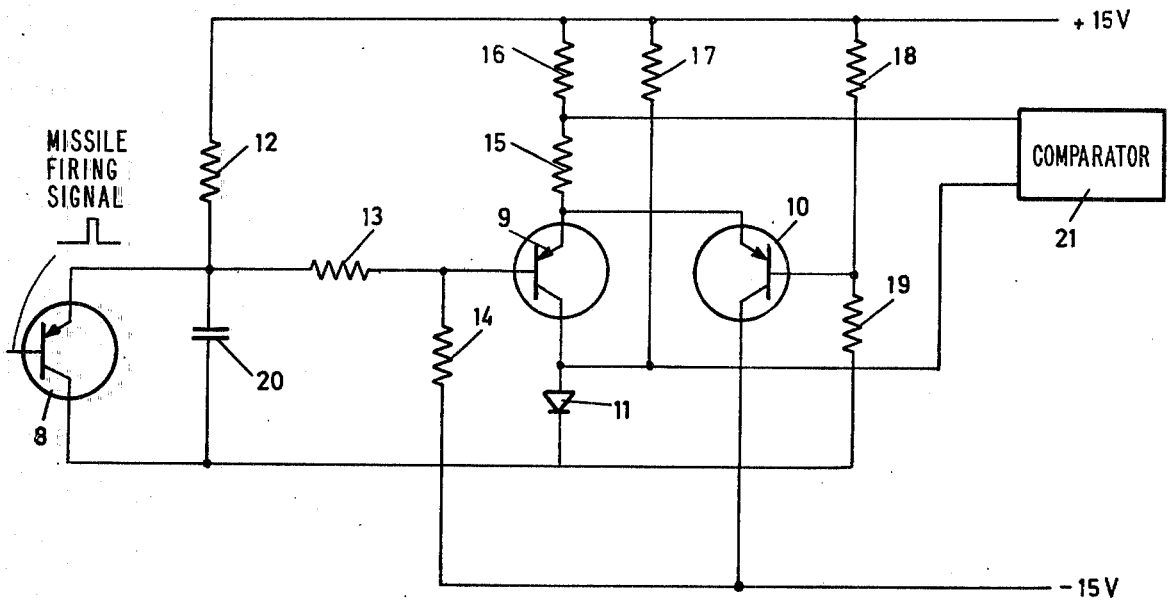
FIG. 2 is a schematic electric wiring diagram of a preferred embodiment of the circuit that achieves said control.

With the aid of the control circuit 4 shown in detail in FIG. 2, it is possible to control the output of the laser diode so that the previously mentioned disadvantages are eliminated. During the time the missile is in the guidance stage, a control signal representative of the desired output of the laser is generated by the control circuit which is of such a nature that the output of the laser diode closely conforms to a curve such as the one shown in FIG. 3. From this curve it will be noted that during an initial stage, the output of the laser diode is at a constant, value Po, after which the output increases with time until the output reaches its saturation value, Pm. Applied to the radiation detector in the receiver in the missile, this means that the intensity of the radiation received is practically constant, as the distance from the transmitter to the missile increases with time. At short distances, the output of the laser diode is thus limited, whereby the disturbance phenomena that occur when very high radiation intensities are influenced by the smoke gases emitted from the missile can be prevented. On the other hand, at long distances, the output effect of the laser diode increases, so that the signal detected in the receiver will be sufficiently strong to give a favourable signal-to-noise ratio.

FIG. 2 shows the wiring diagram for a preferred embodiment of the control circuit 4. In the starting position, the base of the transistor 8 is held at negative potential, and therefore this transistor is saturated. The anode side of the capacitor 20 will thereby be close to ground potential, and the junction between the resistors 13 and 14 will be negative, and therefore the transistor 9 will receive base current, and is saturated. Its emitter potential is then lower than the voltage at the junction between the resistors 18 and 19, and the transistor 10 is thereby kept cut off. As the transistor 9 is saturated, there will be a voltage of approximately 14 volts over the resistors 15 and 16. The values for these have been chosen so that the voltage at the junction between them, which voltage should be fed as a target value to the servo part, corresponds to the transmitted power $P_o$, defined according to FIG. 3.

When the missile is fired, a positive step is fed to the transistor 8, so that it will be cut off. The capacitor 20 will then be charged by the current through the resistor 12, with successively increasing current through the resistor 13, and decreasing base current to the transistor 9 as a result. At the time $t_o$ (FIG. 3) this base current is so low that the transistor releases the saturation position, and then functions instead as an emitter follower. The voltage over the resistors 15 and 16 will then decrease, and the output voltage to the servo 21 will increase as the capacitor 20 is charged. The increasing voltage to the servo has the consequence that the optical output increases successively.

Figure 3:
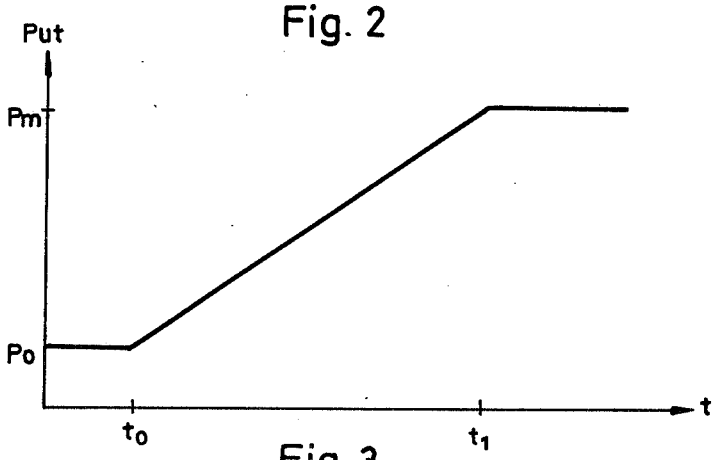
FIG. 3 is a curve showing how the power of the optical guidance beam varies with time.

At the time $t_1$ (FIG. 3) the potential on the emitters of the transistors 9 and 10 is so high that the transistor 10 becomes conductive, and the emitter potential is now determined by the voltage divider 18–19. A constant voltage is now obtained from the voltage divider 15–16 to the servo 21, and the optical output power is now kept constant at the value $P_m$ (FIG. 3).

The purpose of the diode 11 is to compensate for the temperature dependence of the base-emitter voltage drop in the transistors, and the resistor 17 provides the diode with an appropriate idling current. The voltage drop over the diode is fed to the servo part 21, in which it is subtracted from the control voltage.

We claim:

1. Laser beam transmitting apparatus for controlling the output power of a laser diode the beam of which is directed in a selected direction so as to guide a missile or the like along the beam an toward a target, said transmitting apparatus comprising:

first circuit means for supplying a variable amount of power to said diode, second circuit means responsive to the radiation emitted by said diode for generating a first signal representative of the magnitude of said radiation, control circuit means initiated into operation by the firing of the missile for generating a second signal representative of the desired increase of the magnitude of radiation emitted by said diode during the travel time of the missile toward the target, third circuit means for generating a signal proportional to the difference between said first and second signals for controlling the amount of power supplied by said first circuit means to said diode.

2. The apparatus of claim 1 in which said control circuit means comprises, a first transistor, a capacitor connected in parallel with said first transistor, a resistor connected in series with said capacitor, a second transistor having its conductivity controlled in response to the voltage across said capacitor, a voltage divider connected in series with said second transistor and supplying said second signal.

3. The apparatus of claim 2 including means responsive to the firing of the missile for rendering said first transistor non-conductive and in response thereto controlling said second transistor to operate as an emitter follower, whereby the voltage across said voltage divider decreases and said second signal increases in amplitude.

* * * * *